United States Patent [19]

Gaffney

[11] Patent Number: 4,856,685

[45] Date of Patent: Aug. 15, 1989

[54] DISPENSING CONTAINER

[75] Inventor: Daniel P. Gaffney, Durango, Colo.

[73] Assignee: MLW Corporation, LaGrange, Ill.

[21] Appl. No.: 151,458

[22] Filed: Feb. 2, 1988

[51] Int. Cl.[4] ..... G01F 11/26

[52] U.S. Cl. ..... 222/454; 220/94 A; 222/564

[58] Field of Search ..... 222/547, 564, 477, 454, 222/455, 456, 188, 571; 220/94 A, 94 R

[56] References Cited

U.S. PATENT DOCUMENTS

| | | | |
|---|---|---|---|
| 840,532 | 1/1907 | Webb | 222/564 |
| 1,263,682 | 4/1918 | Kriner | 222/484 |
| 1,605,702 | 11/1926 | Brierley | 222/564 |
| 3,353,725 | 11/1967 | Caceres | 222/456 |
| 3,537,498 | 11/1970 | St. Amand | 220/94 A |
| 3,680,744 | 8/1972 | Daniels, Jr. | 222/454 |
| 4,327,861 | 5/1982 | Thompson | 220/94 A |
| 4,394,943 | 7/1983 | Sjonell | 222/456 |

FOREIGN PATENT DOCUMENTS

| | | | |
|---|---|---|---|
| 162516 | 2/1979 | Fed. Rep. of Germany | 222/547 |

*Primary Examiner*—Joseph J. Rolla
*Assistant Examiner*—Kenneth Noland
*Attorney, Agent, or Firm*—Neuman, Williams, Anderson & Olson

[57] ABSTRACT

A fluid dispensing container is provided having an interior baffle member that prevents fluid from flowing out of the container until it is tilted beyond the horizontal position when it is tilted in the direction in which the free distal end of the baffle member is pointed either downward or upward.

6 Claims, 3 Drawing Sheets

FIG. 1
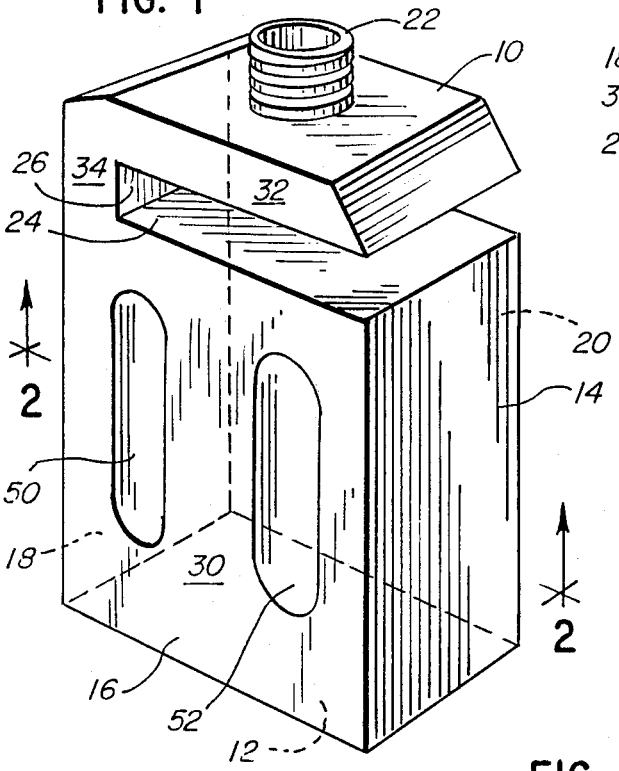
FIG. 2
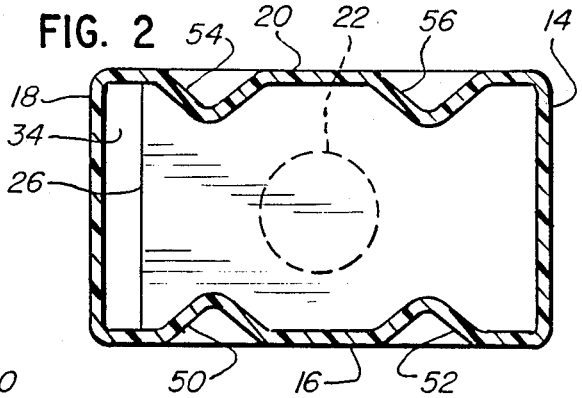
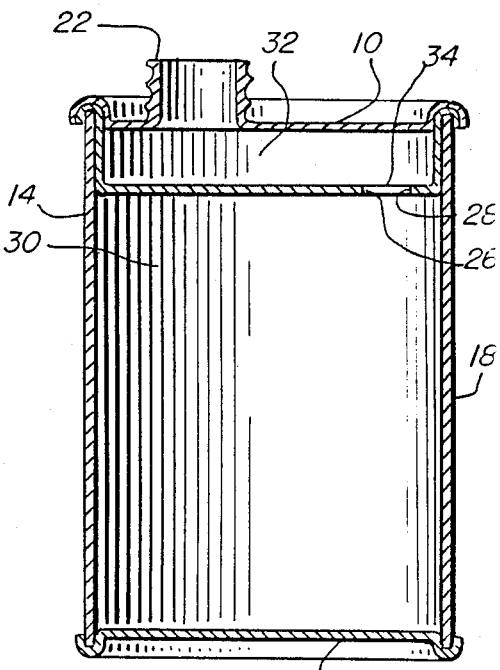
FIG. 4
FIG. 5
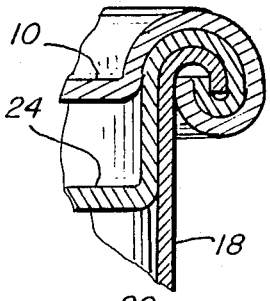
FIG. 3
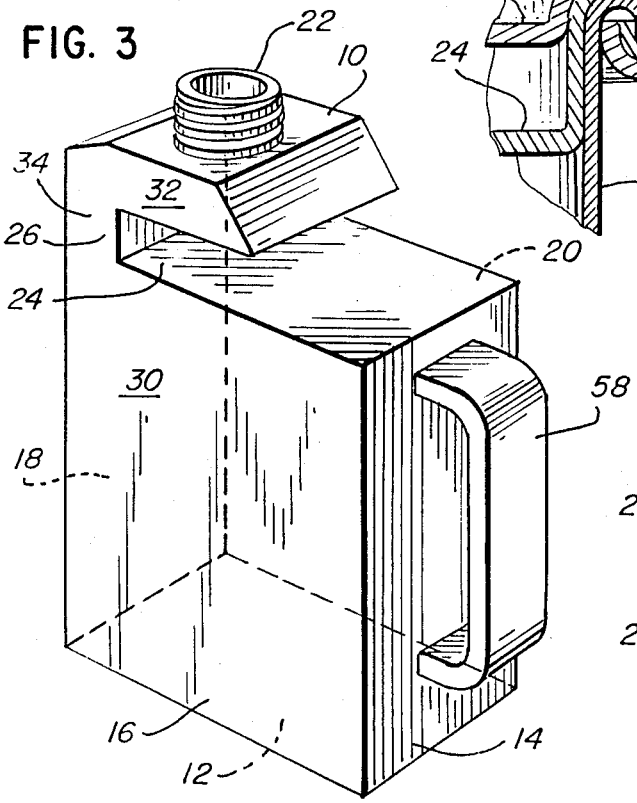
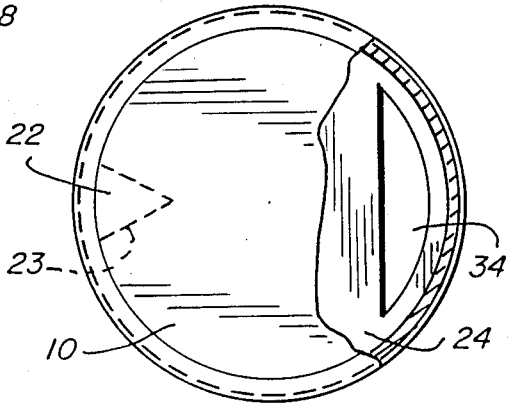
FIG. 6

FIG. 7
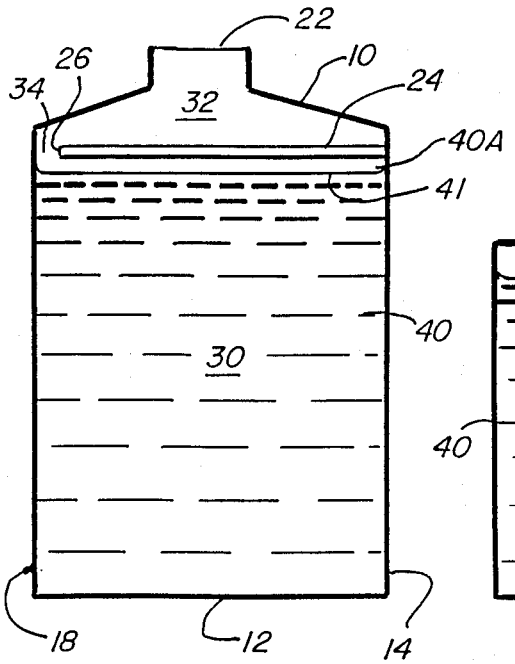
FIG. 8
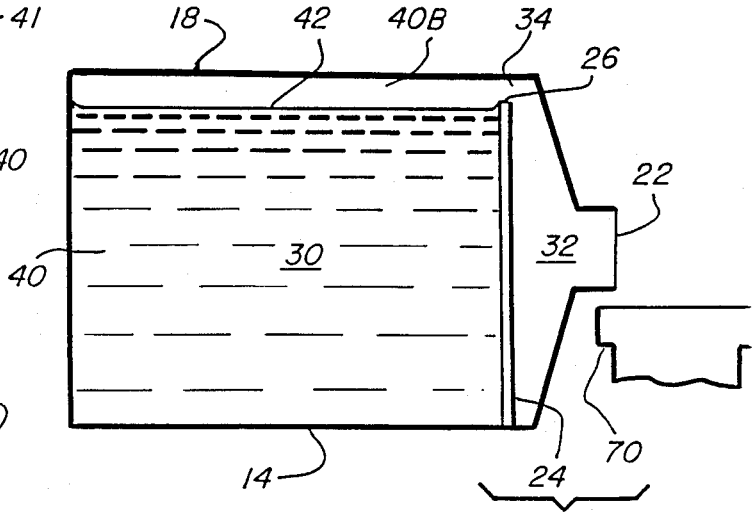
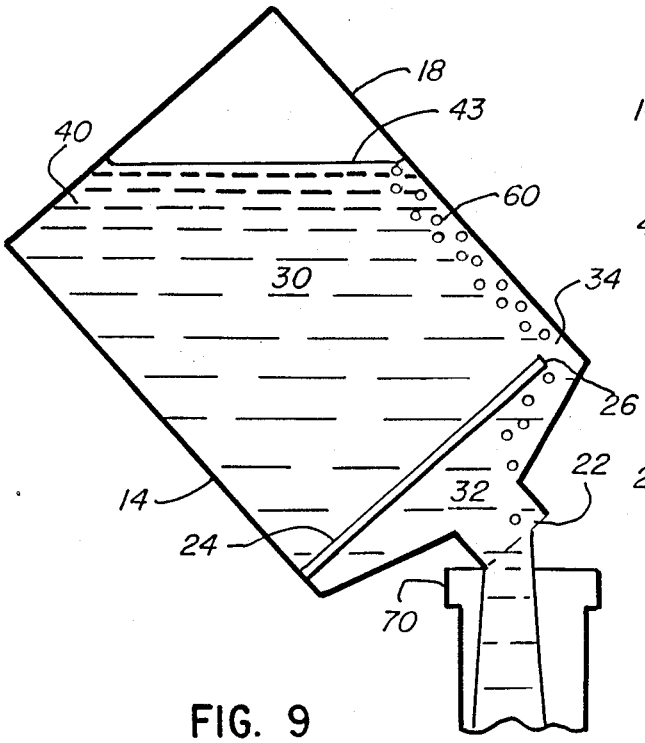
FIG. 9
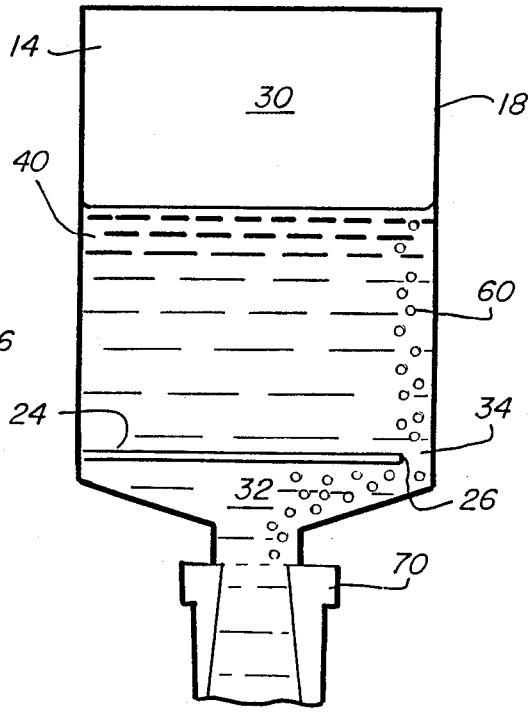
FIG. 10

FIG. 11
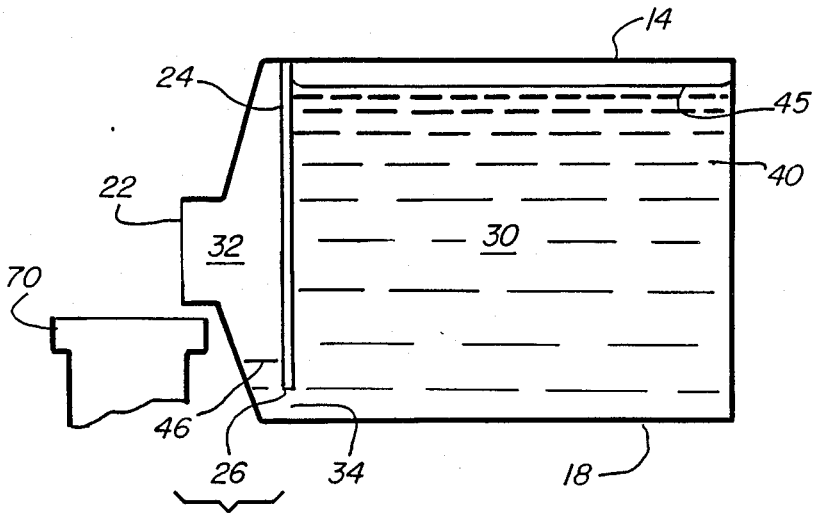
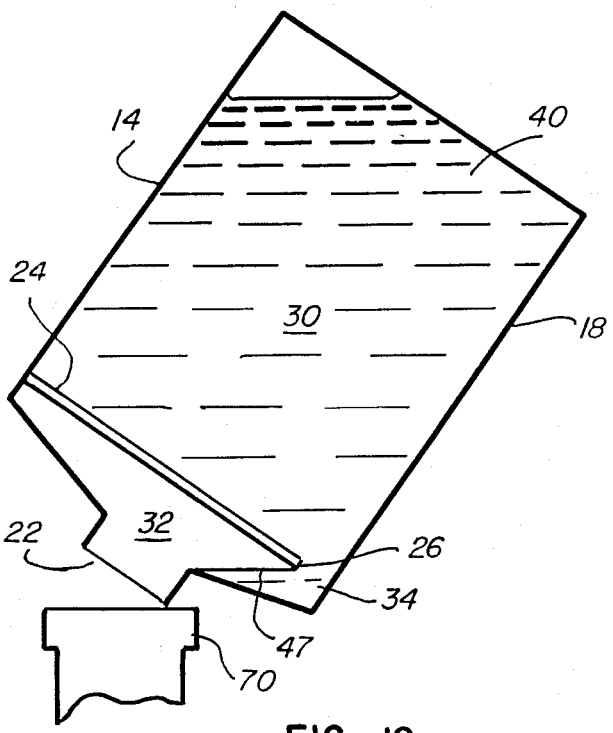
FIG. 12
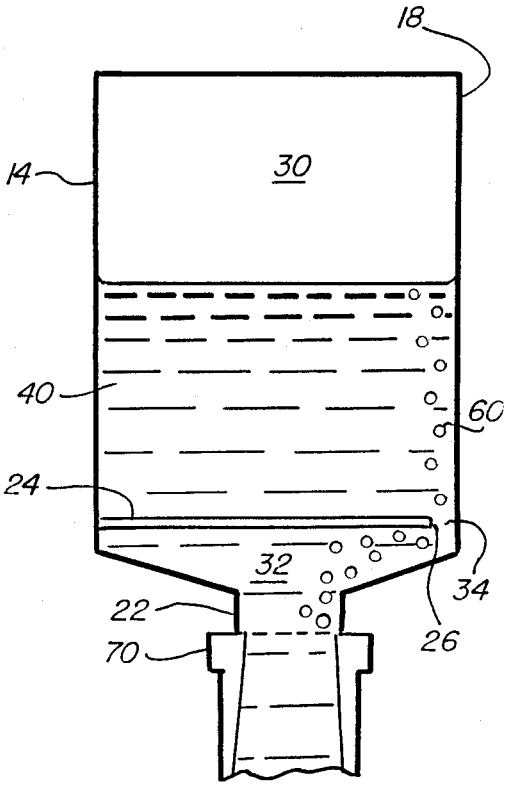
FIG. 13

DISPENSING CONTAINER

BACKGROUND OF THE INVENTION

1. Field of the Invention

This invention relates generally to fluid dispensing containers, and more particularly to fluid dispensing containers of the type from which liquid is dispensed by pouring from a full container, usually into a small opening in a receptacle. An example is in the common quart-sized can or bottle of motor oil from which oil is poured into the oil filler opening of engines.

2. Description of the Prior Art

Conventional fluid dispensing containers typically have a spout which is used along with a funnel inserted into the fill hole of a receptacle in order to prevent spillage of the fluid when the container is tilted from a vertical position. Fluid begins to pour out of a conventional dispensing container before it is tipped beyond a horizontal position. There are many situations, such as, when a person adds motor oil, antifreeze, or other fluids to an automobile, where it is desirable to have a fluid dispensing container that eliminates the need for a funnel and avoids spillage by retaining the fluid until the container is tilted past a horizontal position and allowing the user to place the discharge opening of the container directly on the fill hole.

OBJECTS OF THE INVENTION

Accordingly, it is an object of the present invention to provide an improved fluid dispensing container that eliminates the need for using a funnel in connection with filling operations.

Another object is to provide an improved fluid dispensing container that retains fluid until the container is tilted beyond a horizontal position.

Other objects and advantages of the invention will appear from the following description, accompanying drawings and appended claims.

SUMMARY OF THE INVENTION

The above and other objects are accomplished in accordance with this invention by providing a dispensing container having an interior baffle member that prevents fluid from flowing out a pour opening until the container is tilted beyond the horizontal position. The container comprises top, bottom, front, back and side walls, a discharge opening in the top wall, a baffle member extending from a side wall that divides the container into a top discharge chamber and a bottom fluid storage compartment, and a fluid passageway between the top chamber and bottom compartment. When the container is tilted in the direction in which the baffle member is pointed upward, the baffle member acts as a dam and prevents fluid flow out of the storage compartment and out of the container until the container is tilted beyond its horizontal position. When the container is tilted in the direction in which the baffle member is pointed downward, the baffle member prevents fluid flow out the container until the container is tilted beyond a horizontal position by obstructing the flow of displacement air into the fluid storage compartment.

In the preferred embodiment, the fluid dispensing container comprises a first side wall and a second side wall connecting a bottom wall to a top wall. The discharge opening disposed in the top wall is located over the vertical axis of the fluid dispensing container. The baffle member extends from the first side wall to a point short of the second side wall and divides the container into a top discharge chamber and a bottom fluid storage compartment. The passageway for fluid flow between the discharge chamber and storage compartment is formed between the second side wall and the free distal end of the baffle member. The baffle member prevents fluid flow out of the container until it is tilted beyond the horizontal position when the container is tilted in the direction in which the free distal end is pointed either downward or upward.

The preferred embodiment further comprises gripping indentations disposed in the front and back walls in order to control the pouring plane and direction of tilt employed by the user.

BRIEF DESCRIPTION OF THE DRAWINGS

For a more complete understanding of this invention reference should now be made to the embodiments illustrated in greater detail in the accompanying drawings and described below by way of examples of the invention.

FIG. 1 is a perspective view showing one embodiment of a fluid dispensing container exemplifying the invention.

FIG. 2 is a sectional view taken in the direction of arrows 2—2 in FIG. 1, showing gripping indentations disposed in the front and back walls.

FIG. 3 is a perspective view showing a second embodiment of a fluid dispensing container exemplifying the invention.

FIG. 4 is a sectional view of a cylindrical embodiment of a fluid dispensing container exemplifying the invention.

FIG. 5 is an enlarged detailed sectional view of a portion of FIG. 4 illustrating the rim seal formed by the top wall, side wall, and baffle member.

FIG. 6 is a top view, partially in section, of a second cylindrical embodiment of a fluid dispensing container exemplifying the invention.

FIG. 7 is a schematic side view showing a fluid dispensing container exemplifying the invention, in its vertical position and filled with fluid.

FIG. 8 is a schematic side view of the container from FIG. 7 tilted to its horizontal position with the baffle member pointed upward and in conjunction with a fill hole of a receptacle.

FIG. 9 is a schematic side view of the container from FIG. 8 tilted beyond its horizontal position.

FIG. 10 is a schematic side view of the container from FIG. 9 completely inverted.

FIG. 11 is a schematic side view of the container from FIG. 7 tilted to its horizontal position with the baffle member pointed downward and in conjunction with a fill hole of a receptacle.

FIG. 12 is a schematic side view of the container from FIG. 11 tilted beyond its horizontal position.

FIG. 13 is a schematic side view of the container from FIG. 12 completely inverted.

DETAILED DESCRIPTION OF THE DRAWINGS INCLUDING PREFERRED EMBODIMENTS

Referring now to the drawings, FIG. 1 shows a fluid dispensing container comprising a top wall 10, a bottom wall 12, and a first side wall 14, a front wall 16, a second side wall 18, and a back wall 20 connecting the top 10 and bottom walls 12. A discharge opening 22 located over the central vertical axis of the fluid dispensing container is disposed in the top wall 10. A substantially planar baffle member 24 joined to the first side wall 14 extends horizontally inward from side wall 14 and divides the container into a bottom fluid storage compartment 30 and a top discharge chamber 32. The baffle member 24 extends to a point short of the second side wall 18 and has a free distal end 26. A passageway 34 for fluid flow between the top discharge chamber 32 and the bottom fluid storage compartment 30 is formed between the free distal end 26 of the baffle member 24 and the second side wall 18. Gripping indentations 50,52 are disposed in the front wall 16. FIG. 2 shows gripping indentations 54, 56 disposed in the back wall 20. As will be seen, the user of the fluid dispensing container will control the pouring plane and direction of tilt by grasping either gripping indentations 50 and 54 or gripping indentations 52 and 56. Only one pair of gripping indentations need be provided, preferably gripping indentations 52 and 56.

FIG. 3 shows a fluid dispensing container without gripping indentations. A handle 58 is disposed in the first side wall 14 in order to control the pouring plane and direction of tilt employed by the user. The handle 58 can alternatively be disposed in the second side wall 18 to effect the same purpose. FIG. 3 also illustrates an alternative embodiment wherein the discharge opening 22 is disposed in the portion of the top wall 10 which is between the second side wall 18 and the central vertical axis of the fluid dispensing container.

The embodiments illustrated in FIGS. 1–3 can be made by conventional plastic manufacturing methods.

FIG. 4 illustrates a cylindrical embodiment of the fluid dispensing container shown in a sectional view. In a cylindrical embodiment the first side wall 14 and second side wall 18 are those opposing portions of the unified cylinder wall which are intersected by a diametral plane parallel to the axis of the cylinder. The baffle member 24 extends from the first side wall 14 to the second side wall 18 and is substantially perpendicular to the axis of the cylinder. The passageway 34 for fluid flow between the top discharge chamber 32 and the bottom fluid storage compartment 30 is cut in the baffle member 24. The passageway 34 is located away from the axis of the cylinder and proximate to the second side wall 18. When viewed sectionally as shown in FIG. 4, the baffle member 24 has a free distal end 26 and a second free distal end 28 located opposite the first side wall 14 and close to the second side wall 18. The distance between the free distal end 26 and the second free distal end 28, and hence the lateral dimension of the passageway 34, is substantially smaller than the radius of the cylinder. It will be apparent that the passageway 34 just described for a cylindrical embodiment is a functional equivalent of the passageway 34 illustrated in the embodiments shown in FIGS. 1 and 3. FIG. 4 shows the discharge opening 22 disposed in the portion of the top wall 10 which is between the first side wall 14 and the central vertical axis of the fluid dispensing container. As will be seen, the location of the discharge opening 22, while preferably over the central vertical axis of the container as shown in FIGS. 1 and 2, can be located either closer to the second side wall 18 as shown in FIG. 3 or closer to the first side wall 14 as shown in FIG. 4.

FIG. 5 shows an enlarged view of a portion of the cylindrical embodiment from FIG. 4 and illustrates a method for forming the seal between the top wall 10, the cylinder wall, shown as the second side wall 18, and the baffle member 24. A cylindrical embodiment exemplifying the invention can be manufactured with the top wall 10, the baffle member 24, and the bottom wall 12 made from drawn metal and the cylinder wall made from cardboard as in a conventional quart-sized can for motor oil. It is evident that a cylindrical embodiment can be manufactured with the bottom wall 12 and the cylinder wall made from a continuous sheet of drawn metal. It will also be seen that the methods for manufacturing a cylindrical embodiment just described would apply to embodiments made in other forms, for example, rectangular.

FIG. 6 is a top view, partially in section, of another cylindrical embodiment. A passageway 34 for fluid flow through the baffle member 24 is shown below the top wall 10. Weakened score lines or grooves 23 are formed in the top wall 10 at the side of the cylinder opposite the passageway 34 to provide a discharge opening 22 when the user cuts or pulls away the intervening portion of the top wall 10, as with a piercing implement or a preattached pull tab (not shown).

FIGS. 7–13 illustrate the use and operation of the invention. FIG. 7 is a schematic side view showing a fluid dispensing container exemplifying the invention in its upright, vertical position. The bottom fluid storage compartment 30 is filled with fluid 40 to a level 41 below the baffle member 24.

FIG. 8 illustrates the fluid dispensing container from FIG. 7 tilted to its horizontal position with the free distal end 26 of the baffle member 24 pointed upward. A fill hole 70 of a receptacle is also shown. The baffle member 24 prevents fluid 40 flow out the storage compartment 30 by retaining the fluid 40 at a level 42 at or below the free distal end 26 of the baffle member 24. As will be seen, when the dispensing container is tilted from the vertical position in FIG. 7 to the horizontal position in FIG. 8, the baffle member 24 prevents fluid 40 flow out of the discharge opening 22 by acting as a dam and allows the user to place the discharge opening 22 directly on the fill hole 70 of a receptacle. To this end the filling level of the dispensing container preferably leaves an unfilled volume below the baffle member 24, e.g. at 40A in FIG. 7, which is approximately equal to the volume defined by the second side wall 18 and a liquid surface level with the free distal end 26 when the dispensing container is horizontal, i.e., space 40B in FIG. 8. The latter, of course, will vary with the configuration of the dispensing container walls.

FIG. 9 illustrates the container from FIG. 8 tilted beyond its horizontal position. The tilting of the dispensing container beyond its horizontal position allows the liquid to pour over the free distal end 26 and out of the container. Rapid tilting in excess of this pour rate places the free distal end 26 of the baffle member 24 below the fluid 40 level 43 in the storage compartment 30 and allows displacement air 60 to pass through the discharge opening 22, through the discharge chamber 32, through the passageway 34, and into the fluid storage compartment 30 while fluid 40 flows through the passageway 34, through the discharge chamber 32, and out of the discharge opening 22 into the fill hole 70 of a receptacle.

FIG. 10 illustrates the container from FIG. 9 completely inverted. It is evident that all the fluid 40 from the storage compartment 30 will pass by the baffle member 24 through the passageway 34 and into the fill hole 70 of a receptacle.

FIGS. 11–13 illustrates the fluid dispensing container as it is inverted from its upright horizontal position as shown in FIG. 7 by tilting in the direction in which the free distal end 26 of the baffle member 24 is pointed downward.

FIG. 11 illustrates the dispensing container from FIG. 7 tilted to its horizontal position with the free distal end 26 of the baffle member 24 pointed downward. A fill hole 70 of a receptacle is also shown. As will be seen, as the dispensing container is tilted from the position in FIG. 7 to the position in FIG. 11, the baffle member 24 prevents air from entering the bottom fluid storage compartment 30 after the free distal end 26 of the baffle member 24 intersects the level of fluid 40 in the bottom fluid storage compartment 30.

As shown in FIG. 11, while some air may be trapped by the baffle member 24 in the bottom fluid storage compartment 30 above the fluid 40 at a level 45, the fluid 40 in the discharge chamber 32 at a level 46 below the discharge opening 22 and the baffle member 24 prevent further air from entering the bottom fluid storage compartment 30. Ambient air pressure thus prevents fluid 40 from flowing out of the discharge opening 22 and allows the user to tilt the dispensing container adequately to place the discharge opening 22 directly on the fill hole 70 of a receptacle prior to discharge of the fluid.

FIG. 12 illustrates the container from FIG. 11 tilted beyond its horizontal position. It is to be noted that when the fluid dispensing container is tilted in the direction in which the free distal end 26 of the baffle member 24 is pointed downward, the fluid dispensing container can be tilted beyond the horizontal position while still retaining fluid 40 until the free distal end 26 of the baffle member 24 reaches the same level 47 as the discharge opening 22. Until the fluid 40 in the discharge chamber 32 reaches the same level 47 as the discharge opening 22, the baffle member 24 and fluid 40 below that level 47 prevent displacement air from entering the bottom fluid storage compartment 30 and therefore prevent fluid 40 flow out of the discharge opening 22. It will be seen that when the user tilts the fluid dispensing container beyond the position shown in FIG. 12, air flows through the passageway 34 and into the bottom fluid storage compartment 30 to displace fluid 40 and allow fluid 40 flow out of the bottom fluid storage compartment 30 and out of the discharge opening 22.

FIG. 13 illustrates the container from FIG. 12 completely inverted. As will be seen, all the fluid 40 from the storage compartment 30 will pass by the baffle member 24 and flow through the passageway 34 and into the fill hole 70 as displacement air 60 passes into the storage compartment 30. It will also be seen that tilting the fluid dispensing container as illustrated in FIGS. 11–13 provides an efficient method for using the container to prevent spillage.

The preferred configuration of the fluid dispensing container is rectangular; however it may take other forms, for example, cylindrical. It is preferably made from molded plastic. An alternative embodiment of the invention comprises the discharge opening disposed in the portion of the top wall which is between the second side wall and the vertical axis of the fluid dispensing container. Another alternative embodiment of the invention comprises the discharge opening disposed in the portion of the top wall which is between the first side wall and the vertical axis of the fluid dispensing container.

From the foregoing it will be seen that there has been brought to the art a new and improved fluid dispensing container that retains fluid until the container is tilted beyond the horizontal position and eliminates the need for using a funnel in connection with filling operation.

While particular embodiments and applications of the present invention have been shown, it will be understood, of course, that the invention is not limited thereto since modifications may be made by those skilled in the art, particularly in light of the foregoing teachings. It is therefore contemplated by the appended claims to cover any such modifications as incorporate those features that come within the true spirit and scope of the invention.

What is claimed is:

1. A normally upright liquid container for storing and dispensing a liquid and having a longitudinal axis which extends substantially vertically when said container is upright, comprising:

top, bottom and side walls impervious to the passage of fluids and interconnected to one another in fluid-tight relationship to define such liquid storage container;

means defining a discharge opening through said walls at the top end of said container for discharging liquid therefrom;

a baffle extending transversely of said axis and disposed internally of said container below said discharge opening and above the level to which said container normally is filled with liquid, said baffle joining said walls in fluid-tight relationship and cooperating therewidth to divide said container into a top discharge chamber above said baffle and a storage chamber including the remainder of said container therebelow;

an open passageway through said baffle from said storage chamber to said discharge chamber for free flow of liquid from said storage chamber to said discharge chamber when said container is appropriately tilted, said passageway limited to an area proximate to one side of said container;

said baffle and said walls being impervious to and precluding the passage of fluid between said chambers other than through said passageway;

each of said chambers being open and unobstructed to free flow of liquid in said storage to and through said passageway and to said discharge opening when said container is so tilted;

wherein said baffle is in a position to leave an unfilled volume within said storage chamber, below said baffle and above said normal filling level, which volume is approximately equal to the volume defined by said one side of said container and a liquid surface which is level with the lower edge of said passageway when said axis is horizontal and said one side is upwardly disposed;

whereby gravity-flow of liquid from said storage chamber to said discharge opening is prevented until said container is tilted to or beyond a substantially horizontal position of said axis and is permitted upon further tilting of said container toward an inverted position.

2. A container as defined in claim 1 wherein said discharge opening is offset from said passageway in a direction transverse to said axis.

3. A container as defined in claim 1 further comprising a closure means for cooperating with said discharge opening to retain liquid in said container when in closed relationship therewith.

4. A container as defined in claim 1, 2, or 3, and further comprising gripping means for controlling the pouring plane and the direction of tilt employed by the user of said container.

5. A container as defined in claim 4 wherein said gripping means is disposed on said container and is essentially symmetrical to a plane which is parallel to said axis and passes through both said passageway and said discharged opening.

6. A container as defined in claim 1 wherein said discharge opening is disposed at the side of said container opposite said passageway.

* * * * *